United States Patent [19]

Michel et al.

[11] 4,299,625

[45] Nov. 10, 1981

[54] NIOBIUM-BASE ALLOY

[75] Inventors: David J. Michel, Alexandria, Va.; Hugh H. Smith, Temple Hills, Md.

[73] Assignee: The United States of America as represented by the Secretary of the Navy, Washington, D.C.

[21] Appl. No.: 177,320

[22] Filed: Aug. 12, 1980

Related U.S. Application Data

[63] Continuation of Ser. No. 945,719, Sep. 25, 1978, abandoned.

[51] Int. Cl.[3] ..... C22C 27/02

[52] U.S. Cl. ..... 75/174; 376/900

[58] Field of Search ..... 75/174; 148/32.5, 133, 148/11.5 F; 176/88

[56] References Cited

U.S. PATENT DOCUMENTS

| | | | |
|---|---|---|---|
| 2,973,261 | 2/1961 | Frank | 75/174 |
| 3,219,477 | 11/1965 | Grubessich et al. | 75/174 |
| 3,607,251 | 9/1971 | Osterman | 75/174 |

FOREIGN PATENT DOCUMENTS

| | | | |
|---|---|---|---|
| 909481 | 10/1962 | United Kingdom | 75/174 |

OTHER PUBLICATIONS

"Columbium Base Alloys", General Electric, Feb. 1962, FPL-501-2, p. 10.

*Alloys Index*, vol. 1, 1974, p. 618.

*Chemical Abstracts*, Jun. 30, 1976, vol. 84, Chemical Substance, Index, Part 3, p. 3374cs.

*Chemical Abstracts*, Dec. 31, 1976, vol. 85, Chemical Substance Index, Part 3, p. 3410cs.

Michel et al., "Voids in Neutron Irradiated and Annealed Niobium and Niobium-1% Zirconium Alloy", *Radiation Effects*, 1974, vol. 21, pp. 235-243.

Steele, "Neutron Irradiation Embrittlement of Reactor Pressure Vessel Steels", Tech. Rep. Series No. 163, International Atomic Energy Agency, Vienna 1975, pp. 93-96, 140-145.

Norris, "Voids in Irradiated Metals (Part 1)", *Radiation Effects*, 1972, vol. 14, pp. 1-37.

*Primary Examiner*—Peter K. Skiff

*Attorney, Agent, or Firm*—R. S. Sciascia; William T. Ellis

[57] ABSTRACT

An alloy which is significantly resistant to swelling and irradiation induced hardening when exposed to a high-neutron flux at high temperatures is obtained by alloying from 3 to 7 weight percent of molybdenum and from 0.8 to 1.2 weight percent of zirconium with niobium.

8 Claims, No Drawings

NIOBIUM-BASE ALLOY

This is a continuation, of application Ser. No. 945,719, filed Sept. 25, 1978 now abandoned.

BACKGROUND OF THE INVENTION

The present invention pertains generally to structural materials for fission and fusion-energy-generating systems and particularly to a niobium-base alloy resistant to irradiation-induced hardening and swelling in a high-temperature and high-neutron-flux environment.

The environment of nuclear-energy-generating systems is characterized by high temperatures and high-neutron fluxes throughout the system lifetime. These two characteristics create numerous problems for metals used as construction materials. At a high temperature, a high-neutron flux causes displacement reactions which create point defects of vacancies and interstitials. The point defects often migrate to form line defects termed dislocations to form planar clusters called loops, or to form three-dimensional clusters called voids. It has been determined that dislocations, loops and voids cause a metal to swell and to harden. Hardening results in the metal losing ductility which diminishes the service life of reactor components made from these metals. Void formation and growth also produce dimensional changes in the metal which reduce the service life of the components.

Commercial, nuclear-energy-generating systems utilize either water or helium gas as a coolant. The water-cooled systems operate under the relatively mild conditions of a temperature from 200° to 300° C. and a neutron flux such that the neutron fluence is less than approximately $10^{22}$ neutrons/cm$^2$ during the service life of the system. At these conditions, the currently used materials, e.g. austenitic steels and nickel-base alloys do not undergo an excessive amount of hardening and swelling in view of their cost. In other words, the degradation in the properties of the alloys does not exceed the economy of using these metals.

The systems cooled by helium gas can operate at temperatures from 300° to 600° C. and have a neutron fluence in excess of $10^{23}$ neutrons/cm$^2$ during their service life. Unfortunately, the presently used alloys, e.g. austenitic steel and nickel-base alloys perform poorly at the upper limits. Since these alloys are seriously degraded at a neutron fluence of approximately $10^{22}$ neutrons/cm$^2$ if they were used at operating temperatures from 500° to 600° C., the system can not be operated at their capacity.

Alternatives to austenitic steel or nickel base alloys include ceramics and the niobium-1 weight percent zirconium alloy. Ceramics, such as silicon carbide or nitride have excellent temperature resistance, but have extremely poor ductility. Further, these ceramics degrade upon exposure to neutron radiation. Although the zirconium-base alloy perform slightly better at the higher temperatures of 500° to 600° C. than the presently-used alloys, the additional cost of the alloy makes its use impractical.

Nuclear-energy-generating systems using a liquid metal are in the developmental stage. The operating temperatures and neutron fluxes are similar to the gas-cooled systems. Consequently, these systems are similarly hindered by the limitations of presently-used alloys in their construction.

Considerable experimental work is being conducted on magnetic fusion energy-generating systems. These systems operate at temperatures from 400° to 800° C. and require alloys to be serviceable at neutron fluences from about $10^{24}$ to $10^{26}$ neutrons/cm$^2$. It is evident that the presently used alloys would be completely inadequate for such systems.

SUMMARY OF THE INVENTION

It is, therefore, an object of this invention to provide an alloy which does not significantly harden or swell upon exposure to a temperature above 400° C. and a high-neutron fluence above $10^{22}$ n/cm$^2$.

Another object of this invention is to provide an alloy which can be made and fabricated with standard technology.

A further object of this invention is to provide an alloy which has better performance as construction materials in high temperature, nuclear-energy generating systems than austenitic steel.

A still further object of the present invention is to provide an alloy which is less susceptible to radioactive contamination than nickel or iron base alloys.

These and other objects are achieved by alloying with niobium an amount of zirconium at least sufficient to solid-solution strengthen the alloy, to getter oxygen, and to trap point defects but not more than the solubility limit of zirconium in niobium, and an amount of molybdenum at least sufficient to solid solution strengthen the alloy and to interact with zirconium in the micro-structure to achieve the exceptional point defect trapping found in the alloy but not more than the amount which gives an acceptable ductility.

DETAILED DESCRIPTION OF THE INVENTION

It has been determined that excellent results are obtained if molybdenum and zirconium are added to niobium in the respective amounts of about 3 to about 7 weight percent and of about 0.8 to about 1.2 weight percent. Preferably, the amounts of molybdenum is from 4 to 6 weight percent with 4.5 to 5.5 the most preferred. The preferred amount of zirconium is from 0.9 to 1.1 weight percent and the most preferred amount is from 0.95 to 1.05 weight percent. It is most preferred that no other metal, e.g., iron, aluminum, silicon, magnesium, calcium, vanadium, copper, manganese, chromium, silver and tantalum is present. It is also most preferred that non-metallic elements, e.g., oxygen, nitrogen, carbon, and hydrogen are not present. Preferably, the total of metallic impurities does not exceed 0.05 weight percent and the total of nonmetallic impurities should not exceed 0.02 weight percent. It is also preferred that the total of both types of impurities should not exceed 0.05 weight percent. If the metallic impurities exceed 0.1 weight percent or the non-metallic impurities exceed 0.03 weight percent or the total impurities exceed 0.10 weight percent, the quality of the alloy would seriously be effected.

The alloy can be processed by the usual refractory-metal techniques. Useful structural members can be fabricated with existing technology, e.g., rolling, extrusion, bending, and casting. This alloy should not be exposed to water at high temperatures on account of oxidation. Like many niobium base alloys, this alloy is resistant to corrosion by pure molten alkali metals. Of course, the present alloy can be used in any nuclear system utilizing a vacuum or a high-purity, inert gas as a coolant.

The practice and advantages of the present invention are shown by comparisons of the changes in the microstructure and in mechanical properties of niobium and several alloys after exposure to a high temperature and a high-neutron flux. It is understood that this comparison is given by way of illustration and is not meant to limit the disclosure on the claims to follow in any manner.

The niobium alloys used in these examples were prepared from 99.999 wt.% niobium, molybdenum and zirconium by vacuum are melting. The alloy buttons (approximately 25 grams each) were remelted four times to insure homogeneity and then sectioned to produce 1.52 mm thick slices. Several slices from each alloy were cold rolled to 0.075 mm thickness, and 3.0 mm diameter transmission electron microscopy (TEM) discs were punched from the thin strips. The TEM discs were wrapped in tantalum foil and annealed in vacuum ($<1.3\times10^{-5}$ Pa) at 1150° C. for one hour. The chemical compositions of the alloys and the niobium are given in Table I. The metallic constituents were analyzed spectro-chemically using NBS certified standards. Analysis for oxygen, nitrogen and hydrogen was made by vacuum fusion following annealing. Insufficient material was available for quantitative carbon analysis.

TABLE I

| Chemical Composition (weight percent) | | | | | | | | |
|---|---|---|---|---|---|---|---|---|
| Alloy | Fe | Al | Si | Mg | Ca | Cu | Mn | |
| Nb | 0.001 | 0.001 | 0.001 | 0.0001 | 0.0001 | 0.001 | 0.0001 | |
| Nb—1Mo | 0.001 | 0.001 | 0.05 | 0.0001 | 0.001 | 0.0005 | 0.001 | |
| Nb—5Mo | 0.01 | 0.001 | 0.05 | 0.0001 | 0.001 | 0.0005 | 0.001 | |
| Nb—10Mo | 0.001 | 0.001 | 0.05 | 0.0001 | 0.001 | 0.0005 | 0.001 | |
| Nb—1Zr | 0.001 | 0.0005 | 0.005 | 0.0001 | 0.001 | 0.0001 | 0.0001 | |
| Nb—5Mo—1Zr | 0.001 | 0.0001 | 0.005 | 0.0001 | 0.001 | 0.0001 | 0.0001 | |
| Alloy | Cr | Ta | Nb | Mo | Zr | O | N | H |
| Nb | — | 0.001 | bal. | — | — | 0.0009 | 0.0007 | <0.0001 |
| Nb—1Mo | 0.0001 | 0.001 | bal. | 1.02 | — | 0.0131 | 0.0022 | 0.0007 |
| Nb—5Mo | 0.0001 | 0.001 | bal. | 5.03 | — | 0.0067 | 0.0021 | <0.0001 |
| Nb—10Mo | 0.0001 | 0.001 | bal. | 10.06 | — | 0.0078 | 0.0013 | <0.0001 |
| Nb—1Zr | — | 0.001 | bal. | — | 1.05 | 0.0089 | 0.0033 | <0.0001 |
| Nb—5Mo—1Zr | — | 0.001 | bal. | 5.06 | 1.02 | 0.0115 | 0.0042 | 0.0001 |

The annealed TEM discs were encapsulated in stainless steel tubes under a helium atmosphere and irradiated in the Experiments Breeder Reactor II (EBR-II) to a fast neutron fluence of $1.1\times10^{22}$ N/cm$^2$ (>0.1 MeV), 4 dpa, at 482±15[1]C. Following irradiation, the discs were prepared for TEM examination using the thinning technique disclosed in Sikka et al. (1) Twin-JET Thinning Techniques for Transmission Electron Microscopy Observation of Tantalum and Niobium in J. Less-Common Metals 31: p. 311, 1973. Unirradiated, annealed discs of each alloy also were prepared for TEM study using this technique. The resulting thin foils were examined in a JEM 200 A electron microscope operated at 200 KV and equipped with a double-tilt gonometer stage. Quantitative measurements of void, loop, and dislocation density as well as void and loop size were made using the procuredure disclosed in Michel, D. J. and Moteff, J. (2) Voids in Neutron Irradiated and Annealed Niobium and Niobium-1% Zirconium Alloy. Radiation Effects 121: p. 235–43, 1974. Microhardness measurements were made at room temperature on electropolished discs of both the irradiated and unirradiated niobium and niobium alloys. The measurements were using a Knoop indenter and a 100 gm load. The minimum of four indents was used to obtain the reported hardness values.

The results are summarized in Table II

TABLE 2

| Summary of Experimental Results | | | | | | | |
|---|---|---|---|---|---|---|---|
| | TEM RESULTS | | | | | | |
| Alloy | Dislocation Density, #/cm$^2$ | Loop Density #/cm$^3$ | Mean Loop Diameter A | Void Density, #/cm$^3$ | Mean Void Diameter A | Microhardness (Vickers), MPa | Δ H MPa |
| Nb | $1.9\times10^9$ | — | — | — | — | 916.9 | — |
| | $9.0\times10^9$ | $5.2\times10^{16}$ | 55 | $4.2\times10^{16}$ | 32 | 1843.5 | 926.6 |
| Nb-1Mo | $7.5\times10^9$ | — | — | — | — | 882.5 | — |
| | $1.6\times10^{10}$ | $1.4\times10^{17}$ | 86 | $4.0\times10^{16}$ | 31 | 2235.8 | 1353.2 |
| Nb-5Mo | $9.3\times10^9$ | — | — | — | — | 1431.7 | — |
| | $1.6\times10^{10}$ | $3.0\times10^{17}$ | 46 | — | — | 2990.8 | 1559.2 |
| Nb-10Mo | $3.2\times10^9$ | — | — | — | — | 1657.2 | — |
| | $3.1\times10^{10}$ | $2.8\times10^{17}$ | 54 | — | — | 3186.9 | 1529.7 |
| Nb-1Zr | $3.6\times10^9$ | — | — | — | — | | — |
| | $5.6\times10^{10}$ | $4.0\times10^{17}$ | 62 | — | — | 2824.1 | 1902.4 |
| Nb-5Mo-1Zr | $3.2\times10^9$ | — | — | — | — | 1516.9 | — |
| | $6.5\times10^{10}$ | $6.7\times10^{16}$ | 41 | — | — | 2549.5 | 1032.6 |

The results summarized in Table II demonstrate that the ternary alloy of the present invention is significantly better than pure niobium metal and the other binary niobium-base alloys investigated. A comparison of the Nb-1Zr alloy with the Nb-1Mo alloy reveals that zirconium is a better void suppressor than molybdenum, but the NbZr alloy has a greater increase in hardness (ΔH) than the Nb-1Mo, Nb-5Mo, and Nb-10Mo alloys. What is particularly noteworthy is that the combination of zirconium and molybdenum in niobium produces an alloy having both no voids and a marked reduction in the increased hardness (ΔH) due to neutron irradiation than binary alloys of either zirconium or molybdenum.

Such an alloy would be particularly helpful in magnetic fusion-energy systems.

Obviously many modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. A high temperature and high neutron flux resistant alloy consisting essentially of:

an amount of zirconium at least sufficient to solid solution strengthen the alloy, to getter oxygen, and to trap point defects, but which does not exceed the zirconium solubility limit in niobium, the amount of zirconium is from about 0.8 wt. percent to about 1.2 wt. percent;

an amount of molybdenum at least sufficient to solid-solution strengthen the alloy and to point trap defects, the amount of molybdenum is from about 3.0 to 7.0 weight percent, so as to provide an acceptable ductility limit;

at most 0.1 weight percent of any one, or any combination of the following metallic elements: iron, aluminum, silicon, magnesium, calcium, vanadium, copper, manganese, chromium, silver and tantalum; and at most 0.03 weight percent of any one, or any combination of, the following nonmetallic elements: oxygen, nitrogen, hydrogen and carbon, the sum total of metallic and nonmetallic elements not exceeding 0.1 weight percent;

the remainder being niobium.

2. The alloy of claim 1 wherein the amount of zirconium is from about 0.8 wt percent to about 1.2 wt percent, the solubility limit of Zr in niobium, and the amount of molybdenum is from about 4.0 to 6.0 wt percent.

3. The alloy of claim 2 wherein the amount of said metallic elements does not exceed 0.005 wt percent.

4. The alloy of claim 3 wherein the amount of said nonmetallic elements does not exceed 0.02 wt. percent and the total of metallic and nonmetallic elements does not exceed 0.05 wt percent.

5. A method of use of a niobium base alloy comprising:

fabricating an alloy as claimed in claim 1 into a plurality of structural sheets;

employing at least one of said plurality of structural sheets as a construction material which will be exposed to a severe radiation environment;

exposing said construction material to a severe radiation dosage at high temperatures for a significant period of time.

6. A method as claimed in claim 5 where said plurality of structural sheets are used as construction materials in a nuclear reactor.

7. A method as claimed in claim 5 where said severe radiation environment is a fast neutron fluence of about $10^{22}$ N/cm$^2$ and a temperature in excess of 400° C.

8. A method as claimed in claim 5 where the period of severe radiation exposure is the life expectancy of the reactor.

* * * * *